US009748673B1

(12) United States Patent
Kitatani et al.

(10) Patent No.: US 9,748,673 B1
(45) Date of Patent: Aug. 29, 2017

(54) TERMINAL BLOCK AND ELECTRONIC APPLIANCE

(71) Applicant: TDK CORPORATION, Tokyo (JP)

(72) Inventors: Kazuharu Kitatani, Tokyo (JP); Takashi Saito, Tokyo (JP)

(73) Assignee: TDK CORPORATION, Tokyo (JP)

( * ) Notice: Subject to any disclaimer, the term of this patent is extended or adjusted under 35 U.S.C. 154(b) by 0 days.

(21) Appl. No.: 15/455,862

(22) Filed: Mar. 10, 2017

(30) Foreign Application Priority Data

Mar. 28, 2016 (JP) ..... 2016-062945

(51) Int. Cl.
*H01R 4/34* (2006.01)
*H01R 9/24* (2006.01)
*H01R 9/22* (2006.01)

(52) U.S. Cl.
CPC ..... *H01R 4/34* (2013.01); *H01R 9/223* (2013.01); *H01R 9/24* (2013.01); *H01R 9/2416* (2013.01)

(58) Field of Classification Search
CPC ..... H01R 4/34
See application file for complete search history.

(56) References Cited

U.S. PATENT DOCUMENTS 4,174,147 A * 11/1979 Waddington ..... H01R 12/721 439/249
4,591,950 A * 5/1986 Houpt ..... H01R 4/34 174/541
5,490,044 A * 2/1996 Kobayashi ..... H01R 12/721 361/752
5,789,099 A * 8/1998 Kim ..... H01M 2/30 429/178
6,632,108 B1 * 10/2003 Hohlfelder ..... G08B 25/12 439/709
7,244,148 B2 * 7/2007 Maguire ..... B60L 3/0069 439/620.28
2005/0112955 A1 * 5/2005 Buckley ..... H01R 9/24 439/727
2006/0154498 A1 * 7/2006 Jeong ..... H05K 7/142 439/66
2011/0036624 A1 * 2/2011 Kagimura ..... H05K 1/0263 174/260

(Continued)

FOREIGN PATENT DOCUMENTS

JP S61-042881 A 3/1986
JP 2002-050419 A 2/2002

*Primary Examiner* — James Harvey
(74) *Attorney, Agent, or Firm* — Greenblum & Bernstein, P.L.C.

(57) ABSTRACT

A terminal block includes: a terminal body with a screw hole for a screw used to connect a wire; and a terminal holder that holds the terminal body and has a substrate facing portion placed facing a first surface of a substrate. The terminal block is attached to the substrate by soldering the terminal body to a conductive pattern of the substrate with the substrate facing portion facing the first surface. The terminal holder has the substrate facing portion at one end in a first direction that becomes parallel to the thickness of the substrate when the terminal block is attached to the substrate. A casing fixing portion equipped with an insertion portion, into which a fastener for fixing the terminal holder to a casing that houses the substrate is inserted, is provided at another end in the first direction of the terminal holder.

8 Claims, 4 Drawing Sheets

(56) References Cited

U.S. PATENT DOCUMENTS

| | | | | |
|---|---|---|---|---|
| 2012/0052749 | A1* | 3/2012 | Majewski | H01R 4/44<br>439/813 |
| 2014/0294207 | A1* | 10/2014 | Siegel | H01R 9/223<br>381/120 |
| 2016/0141770 | A1* | 5/2016 | Hoehn | H01R 4/301<br>361/747 |
| 2017/0105285 | A1* | 4/2017 | Kitatani | H05K 1/11 |

* cited by examiner

TERMINAL BLOCK AND ELECTRONIC APPLIANCE

FIELD OF THE INVENTION

The present invention relates to a terminal block that is attached by soldering to an attached substrate and to an electronic appliance housed in a casing after attachment of a terminal block to an attached substrate.

DESCRIPTION OF THE RELATED ART

As one example, in the power supply appliance disclosed in Japanese Laid-open Patent Publication No. 2002-50419, a base equipped with a plurality of terminal blocks configured so that lead wires can be attached using connecting screws is attached to a circuit board. Note here that for ease of comparison with the "terminal block" according to the invention described in this specification, the part named "terminal block" in Publication No. 2002-50419 is referred to here as the "terminal block portion" and the part named "base" in Publication No. 2002-50419 is referred to here as the "terminal block". The terminal block of this power supply appliance includes conductive plates provided with holes (screw holes) into which connecting screws can be screwed and a member (holding member) that is formed of a resin material or the like and holds the conductive plates, and is configured so as to be capable of connecting a plurality of lead wires by having the holding member hold a suitable number of conductive plates for the number of terminal block portions. This terminal block is also configured so as to be attached to a circuit board by connecting (soldering) respective end portions of the conductive plates described above to the circuit board.

On the other hand, Japanese Laid-open Patent Publication No. S61-42881 discloses a terminal apparatus equipped with members (hereinafter also referred to as "terminal bodies") in each of which a joining portion for joining (connecting) a lead wire is integrally formed with a foot portion to be connected by soldering to a conductive portion of a printed circuit board, and a molded resin portion that holds a plurality of such terminal bodies. As described above, this terminal apparatus is configured so that the foot portion of a terminal body is fixed and connected to the printed circuit board by soldering and the molded resin portion is fixed to the printed circuit board by attachment screws that are inserted through attachment holes provided in the molded resin portion.

SUMMARY OF THE INVENTION

However, the terminal block disclosed in Japanese Laid-open Patent Publication No. 2002-50419 described above and the terminal apparatus disclosed in Japanese Laid-open Patent Publication No. S61-42881 described above have the following problems to be solved. That is, the terminal block disclosed in Publication No. 2002-50419 described above is configured so that end portions of the conductive plates are attached to the circuit board by soldering to the circuit board. Also, with the terminal block disclosed in Publication No. 2002-50419, screw holes into which connecting screws can be screwed are formed in the conductive plates from two directions, that is, a direction along the thickness direction of the circuit board and a direction across the board surface of the circuit board.

Here, when a connecting screw is screwed into a conductive plate in the direction along the thickness direction of the circuit board or a connecting screw that has been screwed in in this direction is loosened to connect or remove a lead wire to or from a conductive plate, a tool is pressed onto a head portion of the connecting screw in a direction that presses the terminal block toward the surface of the circuit board (a direction along the thickness direction of the circuit board) and rotated. Accordingly, since the force applied to the connecting screw via the tool is transmitted to the board surface of the circuit board via the holding member that holds the conductive plate, it is possible to rotate the connecting screw without applying a large amount of stress to a soldered portion of the conductive plate.

On the other hand, when a connecting screw is screwed into a conductive plate in the direction across the board surface of the circuit board or a connecting screw that has been screwed in in this direction is loosened to connect or remove a lead wire to or from the conductive plate, a tool is pressed onto a head portion of the connecting screw in the direction across the board surface of the circuit board and rotated. Accordingly, when the tool is pressed onto the head portion of the connecting screw with the force that is necessary to rotate the connecting screw or a greater force, a large force is applied to the terminal block in a direction that causes the holding member to slide across the board surface of the circuit board. This means that stress is applied to the soldered portion of the conductive plate, and due to this, there is the risk of separation of the soldered portion or the production of cracks in the soldered portion.

Even when connecting screws are screwed into the conductive plate and loosened in a direction along the thickness direction of the circuit board, if the terminal block is attached to the circuit board so as to protrude beyond the edge of the circuit board, it becomes harder for the force applied via a tool to the connecting screw to be transmitted via the holding member to the board surface of the circuit board. For this reason, when the tool is pressed onto the head portion of the connecting screw with the force that is necessary to rotate the connecting screw or a greater force, stress is applied to the soldered portion of the conductive plate and due to this, there is the risk of separation of the soldered portion or the production of cracks in the soldered portion.

On the other hand, the terminal apparatus disclosed in Japanese Laid-open Patent Publication No. S61-42881 is configured so that the molded resin portion is fixed to a printed circuit board not only by soldering foot portions of the terminal bodies but also by attachment screws that are inserted through attachment holes provided in the molded resin portion. Accordingly, with the terminal apparatus disclosed in Publication No. S61-42881, although screw holes into which connecting screws can be screwed are formed from a direction across the board surface of the printed circuit board, even if a tool is pressed onto the head portion of the connecting screw with a large force that is necessary to rotate the connecting screw or a greater force, a situation where a large amount of stress is applied to the foot portions (i.e., soldered portions) of the terminal bodies is avoided due to the molded resin portion being fixed to the printed circuit board by the attachment screws.

However, the terminal apparatus disclosed in Publication No. S61-42881 has insertion through-holes through which the attachment screws are inserted provided in extending pieces provided at both ends in the width direction (the left-right direction, or the direction with which the terminal bodies are aligned) of the molded resin portion. Accordingly, with the terminal apparatus disclosed in Publication No. S61-42881, although it is possible to favorably avoid a situation where separation or cracking occurs for foot portions (soldered portions) of the terminal bodies when the connecting screws are rotated, the size in the width direction (left-right direction) increases by an amount equivalent to the protruding pieces provided with the insertion through-holes. This means that with the terminal apparatus disclosed in Publication S61-42881, there is an increase in the occupied area of the printed circuit board, and due to this, it is difficult to miniaturize the printed circuit board and electronic appliances equipped with such printed circuit board.

The present invention was conceived in view of the problems described above and it is a principal object of the present invention to provide a terminal block that is capable of favorably avoiding a situation where separation and cracking of soldered portions of terminal bodies occurs, while sufficiently reducing the area occupied when the terminal block is attached to a circuit board, and to also provide an electronic appliance equipped with such terminal block.

To achieve the stated object, a terminal block according to the present invention comprises a terminal body equipped with a screw hole into which a connecting screw is capable of being screwed to connect a connecting wire; and a terminal holding portion equipped with a substrate facing portion placed facing a first surface of an attached substrate and configured so as to be capable of holding the terminal body, wherein the terminal block is configured so as to be capable of being attached to the attached substrate by soldering the terminal body to a conductive pattern of the attached substrate in a state where the substrate facing portion has been placed facing the first surface, the terminal holding portion is provided with the substrate facing portion at one end in a first direction that becomes parallel to a thickness direction of the attached substrate when the terminal block is attached to the attached substrate, and a casing fixing portion equipped with an insertion portion, into which a fastening member for fixing the terminal holding portion to a casing capable of housing the attached substrate is inserted, is provided at another end in the first direction of the terminal holding portion.

Also, the electronic appliance according to the present invention comprises the terminal block described above wherein the terminal block is attached to the attached substrate, the attached substrate is housed in the casing, and the terminal block is fixed to the casing.

According to the terminal block and the electronic appliance, the force applied to screw a connecting screw into the terminal body and to loosen the connecting screw is distributed among the soldered parts between the terminal body and the attached substrate and among the parts where the casing fixing portions and the casing are fixed, which means that a situation where a large amount of force is applied to soldered parts is favorably avoided. As a result, it is possible to favorably avoid a situation where separation and/or cracks occur at the soldered parts. Also, by providing the substrate facing portion and the casing fixing portions along the first direction along the thickness direction of the attached substrate, compared for example to a configuration where the substrate facing portion and the casing fixing portions are provided across the first surface of the attached substrate, it is possible to sufficiently reduce the area on the attached substrate occupied by the terminal block.

Also, the terminal block according to the present invention comprises the terminal body is configured so that the connecting screw is capable of being screwed into the screw hole in at least one direction out of the first direction and a second direction that becomes parallel to the first surface when the terminal block is attached to the attached substrate, and the terminal holding portion is configured so that when looking along the second direction, the casing fixing portion is positioned within a width range from one end of the terminal body in a third direction that intersects both the first direction and the second direction and another end of the terminal body in the third direction.

According to the terminal block and the electronic appliance, compared to a configuration where the casing fixing portion is provided outside the width range, it is possible to sufficiently reduce the size of the terminal block along the third direction, and as a result, it is possible to sufficiently reduce the area of the attached substrate occupied by the terminal block.

In addition, the terminal block according to the present invention comprises the terminal body is equipped with at least three soldered portions that are inserted through terminal insertion through-holes provided in the attached substrate and are soldered to the conductive pattern, and the soldered portions are disposed so that when looking along the first direction, at least one soldered portion out of the soldered portions is not positioned on a virtual straight line that joins positions of another two out of the soldered portions.

According to the terminal block and the electronic appliance, when a force is applied along the second direction, the soldered portions are not susceptible to deformation compared to a configuration where the soldered portions are disposed so as to be positioned on a single virtual straight line, which means it is possible to favorably avoid a situation where the terminal block becomes inclined relative to the attached substrate, even when the front end of a fastening member hits the rim portion of an insertion portion when the fastening member is inserted into the insertion portion of a casing fixing portion to fix the terminal block to the casing.

It should be noted that the disclosure of the patent invention relates to the contents of Japanese Patent application 2016-62945 that was filed on Mar. 28, 2016, the entire contents of which are herein incorporated by reference.

BRIEF DESCRIPTION OF THE DRAWINGS

These and other objects and features of the present invention will be explained in more detail below with reference to the attached drawings, wherein.

DESCRIPTION OF THE PREFERRED EMBODIMENTS

Preferred embodiments of a terminal block and a power supply apparatus will now be described with reference to the attached drawings.

Figure 1:
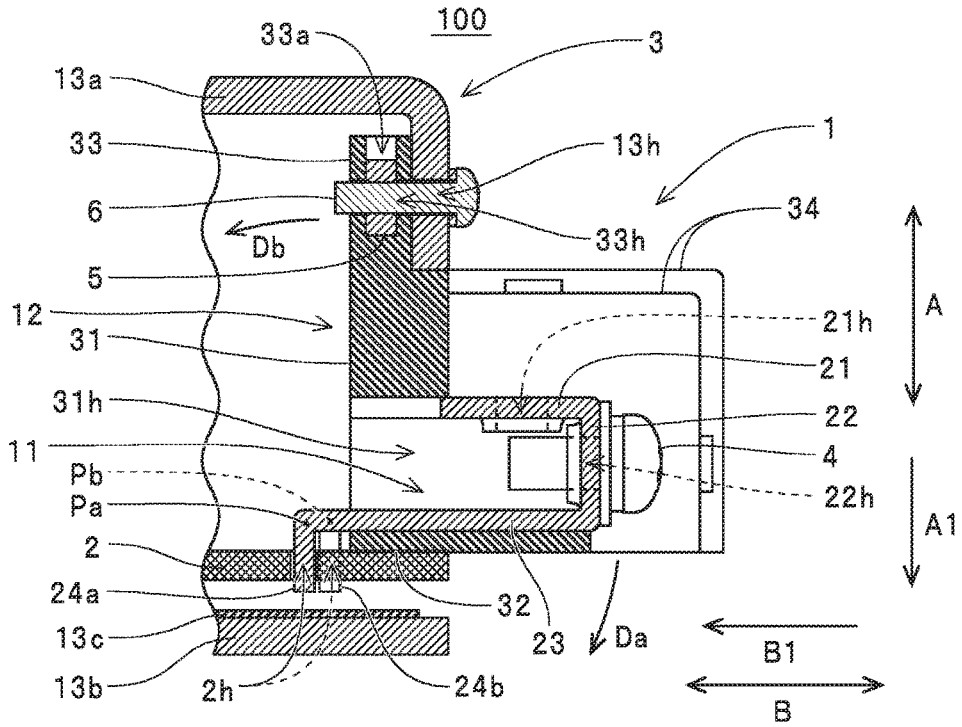
FIG. 1 is a cross-sectional view of a vicinity of a terminal block of a power supply apparatus.

A power supply apparatus 100 depicted in FIG. 1 is one example of an "electronic appliance" according to the present invention and is configured by housing a circuit board 2, on which a terminal block 1 has been attached, inside a casing 3.

The circuit board 2 is one example of an "attached substrate" for the present invention. A conductive pattern, not illustrated, is formed on the circuit board 2, and the terminal block 1 and various electronic components, not illustrated, that construct a power supply circuit are mounted on (attached to) the circuit board 2. The casing 3 is one example of a "casing" for the present invention, includes an upper case 13*a* and a lower case 13*b* formed of metal plates, and is configured so as to house the circuit board 2 in a state where the terminal block 1 has been attached. Here, as described later, insertion through-holes 13*h*, through which fixing screws 6 can be inserted to fix the terminal block 1, are formed in the upper case 13*a*.

In addition, the terminal block 1 is a substrate-mounted terminal block as one example of a "terminal block" according to the present invention, and as depicted in FIGS. 1 to 5, includes a pair of terminal bodies 11 and a terminal holding portion 12 that holds both terminal bodies 11. The terminal bodies 11 are one example of "terminal bodies" for the present invention and are composed of metal plates that include screw holes 21*h* and screw holes 22*h* into which connecting screws 4 (one example of "connecting screws" for the present invention) for connecting connecting wires (or "lead wires" or "power supply wires"), not illustrated.

Here, screw holes 21*h*, into which the connecting screws 4 can be screwed along a "first direction" (the height direction for the terminal block 1: the direction of the arrow A in FIGS. 1 to 4) that becomes parallel to the thickness direction of the circuit board 2 when the terminal block 1 is attached to the circuit board 2, are formed in an upper-surface-side plate-like portion 21 of each terminal body 11 in the terminal block 1 according to the present embodiment. In addition, screw holes 22*h*, into which connecting screws 4 can be screwed along a "second direction" (a direction from a front surface toward a rear surface of the terminal block 1: the direction of the arrow B in FIGS. 1, 2, and 5) that becomes parallel to a first surface (or "board surface" or "component mounting surface") of the circuit board 2 when the terminal block 1 is attached to the circuit board 2, are formed in a front-surface-side plate-like portion 22 of the terminal body 11. This configuration is an example where "at least one direction" means the "first direction" and the "second direction".

Figure 5:
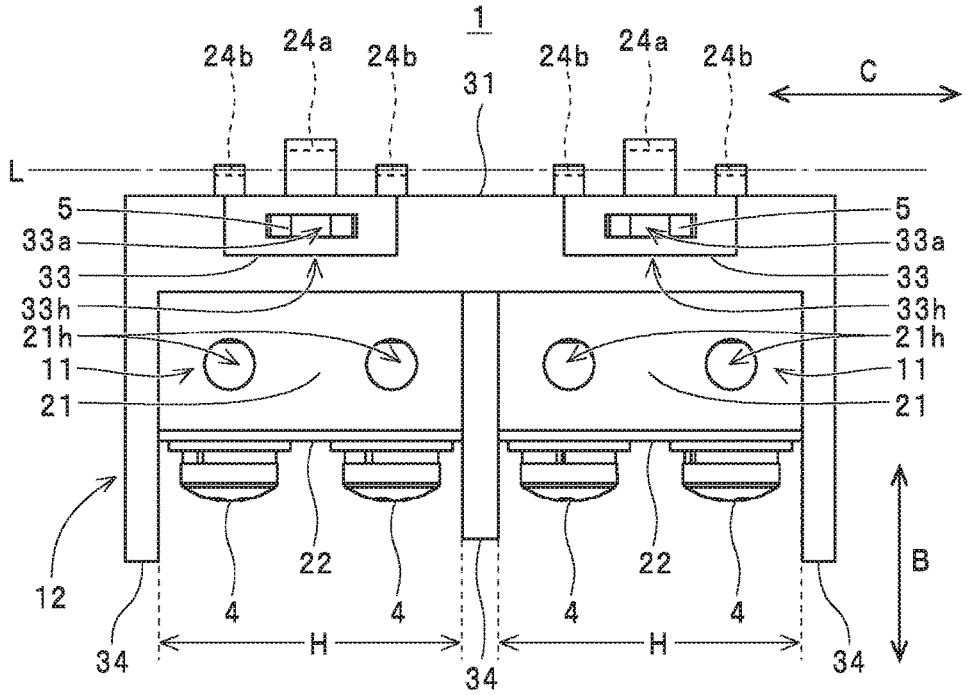
FIG. 5 is a plan view of the terminal block.

Also, each terminal body 11 of the terminal block 1 according to the present embodiment is equipped with three soldered portions 24*a*, 24*b*, and 24*b*, which are passed through terminal insertion through-holes 2*h* (one example of "terminal insertion through-holes" for the present invention: see FIG. 1) provided in the circuit board 2 and soldered to a conductive pattern, not illustrated, on a rear surface-side (i.e., the opposite side to the front-surface-side plate-like portion 22) of the base surface-side plate-like portion 23. Here, as depicted in FIG. 5, with the terminal block 1, when looking along the "first direction" described above, the positions of the soldered portions 24*a*, 24*b*, and 24*b* are decided so that the soldered portion 24*a* (one example of "at least one soldered portion out of the soldered portions") is not positioned on a dot-dash line L (one example of a "virtual straight line" for the present invention) that joins the positions of the soldered portions 24*b* and 24*b* (one example of "another two out of the soldered portions" for the present invention).

On the other hand, the terminal holding portion 12 is one example of a "terminal holding portion" for the present invention. As depicted in FIGS. 1 to 5, the terminal holding portion 12 has a holding portion body 31 that is configured so as to be capable of holding both terminal bodies 11 and has a substrate facing portion 32 (one example of a "substrate facing portion" for the present invention) that is placed facing the first surface of the circuit board 2 (in the present embodiment, is placed in contact with the first surface of the circuit board 2), casing fixing portions 33 (one example of "casing fixing portions" for the present invention) for fixing the terminal holding portion 12 to the casing 3, and partition walls 34 that partition a region where connecting wires are connected to the terminal bodies 11, with these elements being integrally formed using an insulating material such as a resin material. Also, as depicted in FIGS. 1 and 4, terminal insertion holes 31*h* into which the terminal bodies 11 are capable of being press-fitted from the rear surface-side toward the front surface-side (from the left to the right in FIG. 1) are formed in the holding portion body 31.

In addition, as depicted in FIGS. 1 to 5, insertion holes 33*h* (one example of "insertion portions" for the present invention), into which the fixing screws 6 (one example of "fastening members" for the present invention) can be inserted to fix the terminal holding portion 12 to the casing 3 (the upper case 13*a*), and nut receiving holes 33*a*, into which fixing nuts 5 into which the fixing screws 6 are tightened are fitted, are formed in the casing fixing portions 33. The casing fixing portions 33 protrude upward from the holding portion body 31 with the fixing nuts 5 fitted into the nut receiving holes 33*a*. Here, with the terminal block 1 according to the present embodiment, the substrate facing portion 32 is provided at one end (the lower end) in the "first direction" of the holding portion body 31, and the casing fixing portion 33 is provided at the other end (the upper end) in the same first direction of the holding portion body 31.

Figure 2:
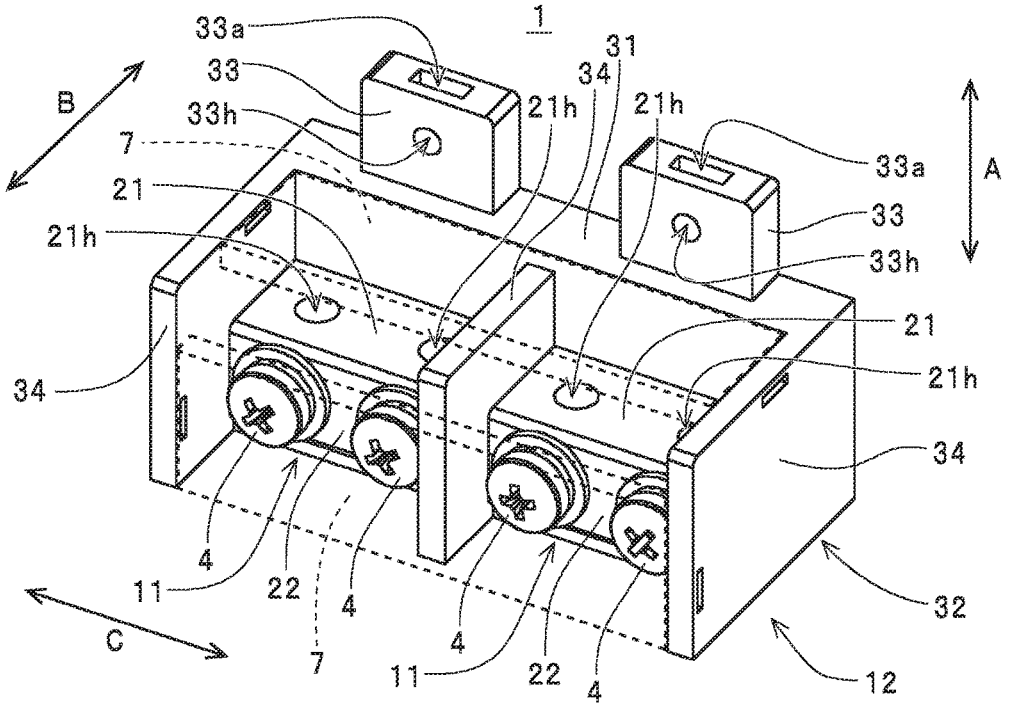
FIG. 2 is a perspective view of the terminal block.
Figure 3:
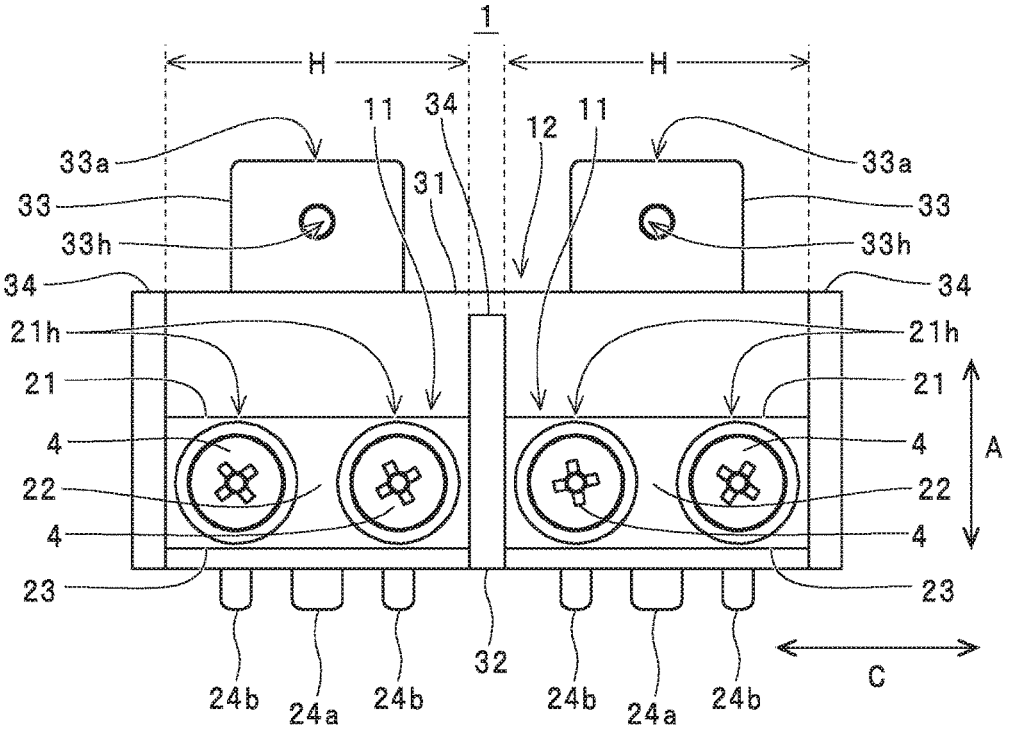
FIG. 3 is a front view of the terminal block.
Figure 4:
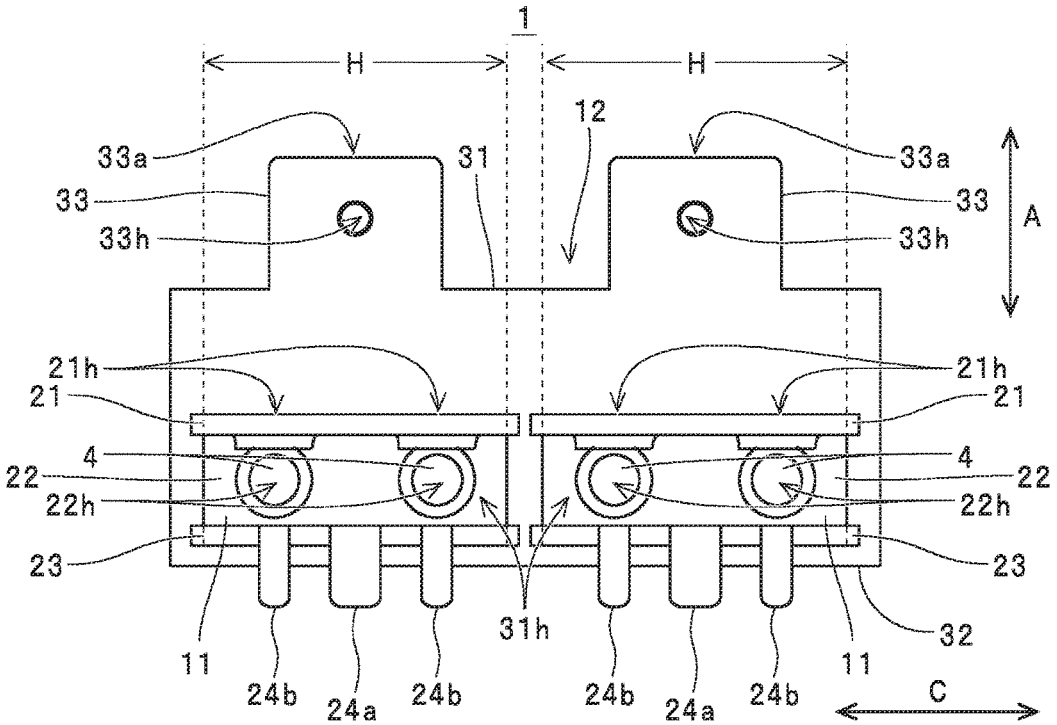
FIG. 4 is a rear view of the terminal block.

As depicted in FIG. 3, when looking at the terminal holding portion 12 along the "second direction" (the direction from the front surface toward the rear surface of the terminal block 1: a direction from an outside to an inside of the casing 3 for an attachment portion of the terminal block 1), the terminal block 1 according to the present embodiment is configured so that one casing fixing portion 33 is positioned in a width range H that extends from one end (the left end in FIG. 3) of each terminal body 11 in the width direction of the terminal block 1 (the direction in which the terminal bodies 11 are aligned: one example of a "third direction that intersects both the first direction and the second direction" for the present invention, the direction of the arrow C in FIGS. 2 to 5) to the other end (the right end in FIG. 3) of the terminal 11 in the width direction (the "third direction"). Here, with the terminal block 1 according to the present embodiment, the terminal holding portion 12 is also configured so that each insertion hole 33*h* in which a fixing screw 6 is inserted is provided in a casing fixing portion 33 so as to be positioned within the width range H and the entire casing fixing portion 33 that includes such insertion hole 33*h* is also positioned within the width range H described above.

Also, as depicted in FIG. 2, with the terminal block 1 according to the present embodiment, attachment holes, to which a protective cover 7 can be attached, are formed in the partition walls 34. The protective cover 7 covers and protects the connecting screws 4 and the connecting wires when the connecting screws 4 have been screwed into the screw holes 21*h* of the terminal bodies to connect the connecting wires to the terminal bodies 11 (the upper-surface-side plate-like portion 21) and when the connecting screws 4 have been screwed into the screw holes 22*h* of the terminal bodies 11 to connect the connecting wires to the terminal bodies 11 (the front-surface-side plate-like portion 22).

When manufacturing (assembling) the power supply apparatus 100, first the terminal block 1 and the other electronic components that construct a power supply circuit are attached to (mounted on) the circuit board 2. More specifically, the soldered portions 24*a* and 24*b* of the terminal bodies 11 are inserted through the terminal insertion through-holes 2*h* (see FIG. 1) formed in the circuit board 2 and the substrate facing portion 32 of the terminal holding portion 12 is placed in contact with the first surface of the circuit board 2 to dispose the terminal block 1 on the circuit board 2 (one example of a state where the "substrate facing portion has been placed facing the first surface"). Next, the soldered portions 24*a* and 24*b* that have been inserted through the terminal insertion through-holes 2*h* are soldered to a conductive pattern, not illustrated, on the rear surface side (the lower surface side in FIG. 1) of the circuit board 2. By doing so, the terminal bodies 11 of the terminal block 1 are connected to the power supply circuit of the circuit board 2 and attachment (mounting) of the terminal block 1 on the circuit board 2 is completed.

The circuit board 2 is then housed inside the casing 3. More specifically, first, the circuit board 2 is fixed to the lower case 13*b* by fixing screws, not illustrated. Here, as depicted in FIG. 1, the power supply apparatus 100 according to the present embodiment is configured to house the circuit board 2 inside the casing 3 so that the circuit board 2 is positioned in the vicinity of an inner surface of the lower case 13*b*. Accordingly, with the power supply apparatus 100, to prevent connection terminals (the soldered portions 24*a* and 24*b* and the like of the terminal block 1) that protrude on the rear surface-side of the circuit board 2 from directly contacting the lower case 13*b*, a configuration is used where the circuit board 2 is fixed to the lower case 13*b* in a state where an insulating sheet 13*c* is interposed between the lower case 13*b* and the circuit board 2.

Note that the fixing nuts 5 mentioned above are fitted into the nut receiving holes 33*a* of the casing fixing portion 33 either before the terminal block 1 is attached to the circuit board 2 (i.e., when the terminal block 1 is fabricated) or when the terminal block 1 is attached to the circuit board 2. Next, the upper case 13*a* is placed on and fixed to the lower case 13*b* to which the circuit board 2 has been fixed. More specifically, first the upper case 13*a* is placed on the lower case 13*b*. At this time, as depicted in FIG. 1, the formation positions of the insertion through-holes 13*h* of the upper case 13*a* are positioned to the outside of the casing fixing portions 33 of the terminal block 1 that has been attached to the circuit board 2 to produce a state where the insertion holes 33*h* of the casing fixing portion 33, the screw holes of the fixing nuts 5 fitted into the nut receiving holes 33*a*, and the insertion through-holes 13*h* are lined up in the "second direction".

Next, the fixing screws 6 inserted through the insertion through-holes 13*h* are inserted into the insertion holes 33*h* and screwed into the fixing nuts 5 inside the nut receiving holes 33*a*. When the upper case 13*a* has been placed on the lower case 13*b* to which the circuit board 2 has been fixed, there are cases where slight displacements are produced between the insertion through-holes 13*h* of the upper case 13*a* and the insertion holes 33*h* of the casing fixing portions 33 of the terminal block 1 that has been attached to the circuit board 2. When inserting the fixing screws 6, which have been inserted through the insertion through-holes 13*h* of the upper case 13*a*, into the insertion holes 33*h* of the casing fixing portion 33 in this state, the front ends of the fixing screws 6 may hit the rim portions (the casing fixing portions 33) of the insertion holes 33*h*, and as a result, there is the risk of a force the presses the casing fixing portions 33 being applied in the direction in which the fixing screws 6 are being inserted (a direction across the first surface of the circuit board 2).

Figure 6:
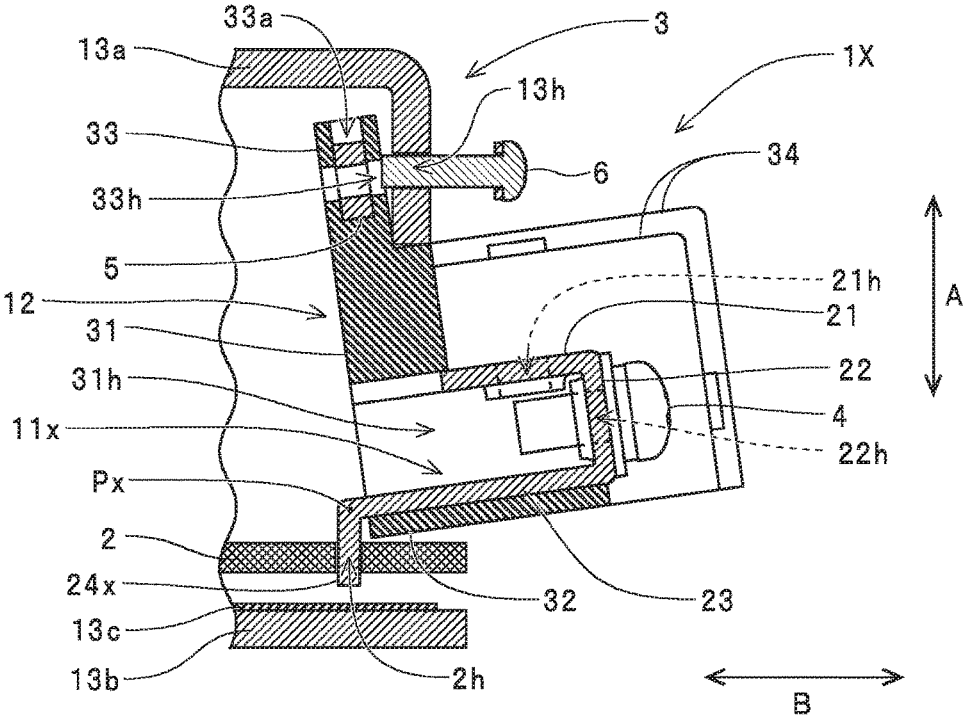
FIG. 6 is a diagram useful in explaining an example of a task that attaches a terminal block to an upper case of a casing using fixing screws.

Here, although different to the terminal block 1 according to the present embodiment, like a terminal block 1X depicted in FIG. 6, it is also possible to configure a "terminal block" equipped with terminal bodies 11*x* disposed so that the soldered portions 24*x* are disposed on one "virtual straight line" (as one example, so that as to be positioned on the same virtual straight line as the dot-dash line L on which the soldered portions 24*b* and 24*b* of the terminal block 1 are positioned). With such terminal block 1X, bent parts of the soldered portions 24*x* (i.e., parts where the physical strength is slightly weaker due to bending of the metal plate when the terminal bodies 11*x* are fabricated) are disposed on a straight line that passes the point Px depicted in FIG. 6.

Accordingly, when, in a state where the terminal block 1X has been attached to the circuit board 2, a worker attempts to insert fixing screws 6 that hit the rim portions (the casing fixing portions 33) of the insertion holes 33*h* into the insertion holes 33*h* along the "second direction", there is the risk that deformation will occur at the bent parts of the soldered portions 24*x*, the terminal block 1X will become inclined to the circuit board 2 with the bent parts as the center of rotation, and the substrate facing portion 32 will become separated from the first surface of the circuit board 2. In this case, stress becomes applied to the vicinity of the terminal insertion through-holes 2*h* of the circuit board 2 and to the soldered portions 24*x*, resulting in the risk of cracking of the solder that connects the soldered portions 24*x* and the conductive pattern and the risk of separation of the components.

On the other hand, as described earlier, with the terminal block 1 according to the present embodiment, the soldered portions 24*a*, 24*b*, and 24*b* are disposed so that when looking along the "first direction", the soldered portion 24*a* is not positioned on the "virtual straight line" (the dot-dah line L depicted in FIG. 5) that joins the positions of the soldered portions 24*b* and 24*b*. This means that with the terminal block 1 according to the present embodiment, the bent part of the soldered portion 24*a* is positioned on a straight line that passes the point Pa depicted in FIG. 1 and the bent parts of the soldered portions 24*b* are positioned on a straight line that passes the point Pb depicted in FIG. 1.

Accordingly, with the terminal block 1 according to the present embodiment, in a state where a fixing screw 6 hits the rim portion (the casing fixing portion 33) of an insertion hole 33*h* due to slight displacements produced between the insertion through-holes 13*h* and the insertion holes 33*h*, even if a force that presses the casing fixing portion 33 is applied in the direction in which the fixing screw 6 is being inserted (a direction across the first surface of the circuit board 2) due to the fixing screw 6 being inserted into the insertion hole 33*h* along the "second direction", the bent parts of the soldered portions 24*a*, 24*b*, and 24*b* are not susceptible to deforming due to the bent parts of the soldered portions 24*a*, 24*b*, and 24*b* not being positioned on the same straight line. As a result, a situation where the terminal block 1 becomes inclined to the circuit board 2 and the substrate facing portion 32 becomes separated from the first surface of the circuit board 2 is favorably avoided.

After this, by sufficiently tightening the fixing screws 6 into the fixing nuts 5 fitted into the nut receiving holes 33*a* of the casing fixing portion 33, as depicted in FIG. 1, the terminal block 1 (the casing fixing portion 33) is fixed to the upper case 13*a* in a state where the rim portions of the insertion through-holes 13*h* in the upper case 13*a* are tightly attached to the rim portions of the insertion holes 33*h* of the casing fixing portions 33. By doing so, housing of the circuit board 2 in the casing 3 and fixing of the terminal block 1 that is attached to the housed circuit board 2 to the casing 3 (the upper case 13*a*) are completed, thereby completing the power supply apparatus 100.

When the power supply apparatus 100 is used, connecting wires are connected to the terminal bodies 11 and 11 of the terminal block 1. Here, as described earlier, in the terminal block 1 of the power supply apparatus 100 according to the present embodiment, the screw holes 21*h* into which the connecting screws 4 for connecting the connecting wires to the terminal bodies 11 can be screwed are formed along the thickness direction (the direction of the arrow A depicted in FIG. 1) of the circuit board 2 and the screw holes 22*h* into which the connecting screws 4 can be screwed are formed along a direction across the first surface of the circuit board 2 (the direction of the arrow B depicted in FIG. 1).

Here, when connecting a connecting wire to a terminal body 11 by screwing a connecting screw 4 into a screw hole 21*h* formed in the upper-surface-side plate-like portion 21, a tool is pressed onto the head portion of the connecting screw 4 in the direction of the arrow A1 depicted in FIG. 1 (the downward direction in FIG. 1). This means that when the connecting screw 4 is tightened in the screw hole 21*h* and when the connecting screw 4 screwed into the screw hole 21*h* is loosened, a force that tries to rotate the terminal block 1 with respect to the circuit board 2 about the vicinity of the substrate facing portion 32 as the center of rotation is applied (in the clockwise direction in FIG. 1). However, with the terminal block 1 according to the present embodiment, since the casing fixing portions 33 are fixed to the casing 3 (the upper case 13*a*) by the fixing screws 6, even when the force described above is applied, a situation where the terminal block 1 rotates in the direction of the arrow Da is favorably avoided, and a situation where a large amount of stress is applied to the soldered parts between the soldered portions 24*a*, 24*b*, and 24*b* and the circuit board 2 is avoided. As a result, it is possible to tighten and loosen a connecting screw 4 while pressing a tool onto the head portion of the connecting screw 4 with a sufficient force to prevent slipping.

Also, when connecting a connecting wire to a terminal body 11 by screwing a connecting screw 4 into a screw hole 22*h* formed in the front-surface-side plate-like portion 22, a tool is pressed onto the head portion of the connecting screw 4 in the direction of the arrow B1 depicted in FIG. 1 (the direction from right to left in FIG. 1). This means that when the connecting screw 4 is tightened in the screw hole 22*h* and when the connecting screw 4 screwed into the screw hole 22*h* is loosened, a force that rotates the terminal block 1 with respect to the circuit board 2 in the direction of the arrow Db (the counter-clockwise direction in FIG. 1) with the vicinity of the soldered portions 24*a*, 24*b*, and 24*b* as the center of rotation is applied. However, with the terminal block 1 according to the present embodiment, since the casing fixing portions 33 are fixed to the casing 3 (the upper case 13*a*) by the fixing screws 6, even if the type of force described above is applied, a situation where the terminal block 1 rotates in the direction of the arrow Db is favorably avoided and a situation where a large amount of stress is applied to the soldered parts between the soldered portions 24*a*, 24*b*, and 24*b* and the conductive pattern of the circuit board 2 is avoided. As a result, it is possible to tighten and loosen a connecting screw 4 while pressing a tool onto the head portion of the connecting screw 4 with sufficient force to prevent slipping.

In this way, the terminal block 1 is configured so as to be capable of being attached to the circuit board 2 by soldering the terminal bodies 11 to the conductive pattern of the circuit board 2 in a state where the substrate facing portion 32 provided on the terminal holding portion 12 has been placed facing the first surface of the circuit board 2. The terminal block 1 includes the substrate facing portion 32 at one end of the terminal holding portion 12 in the "first direction" that becomes parallel to the thickness direction of the circuit board 2 when the terminal block 1 is attached to the circuit board 2, and the casing fixing portions 33 provided with the insertion holes 33*h* into which the fixing screws 6 can be inserted to fix the terminal holding portion 12 to the casing 3 capable of housing the circuit board 2 are provided at the other end of the terminal holding portion 12 in the "first direction". Also, with the power supply apparatus 100, the terminal block 1 described above is attached to the circuit board 2, the circuit board 2 is housed inside the casing 3, and the terminal block 1 is fixed to the casing 3.

According to the terminal block 1 and the power supply apparatus 100 described above, the force applied to screw a connecting screw 4 into the terminal body 11 and to loosen the connecting screw 4 is distributed among the soldered parts between the terminal body 11 (the soldered portions 24*a*, 24*b*, and 24*b*) and the circuit board 2 and among the parts where the casing fixing portions 33 and the casing 3 (the upper case 13*a*) are fixed, which means that a situation where a large amount of force is applied to soldered parts is favorably avoided. As a result, it is possible to favorably avoid a situation where separation and/or cracks occur at the soldered parts. Also, by providing the substrate facing portion 32 and the casing fixing portions 33 along the "first direction" along the thickness direction of the circuit board 2, compared for example to a configuration where the "substrate facing portion" and the "casing fixing portions" are provided across the first surface of the attached substrate, it is possible to sufficiently reduce the area on the circuit board 2 occupied by the terminal block 1.

Also, with the terminal block 1, the terminal bodies 11 are configured so that the connecting screws 4 can be screwed into the screw holes 21*h* and 22*h* along at least one direction (in the present embodiment, both directions) out of the "first direction" and a "second direction" that becomes parallel to the first surface of the circuit board 2 when the terminal block 1 is attached to the circuit board 2. Also, the terminal holding portion 12 is configured so that when looking along the "second direction", each casing fixing portion 33 is positioned in a width range H from one end of a terminal body 11 in a third direction that intersects (in the present embodiment, "is perpendicular to") both the "first direction" and the "second direction" to the other end of the terminal body 11 in the "third direction". Therefore, according to the terminal block 1 and the power supply apparatus 100, compared to a configuration where the "casing fixing portion" is provided outside the width range H, it is possible to sufficiently reduce the size of the terminal block 1 along the "third direction", and as a result, it is possible to sufficiently reduce the area of the circuit board 2 occupied by the terminal block 1.

In addition, with the terminal block 1, each terminal body 11 includes the three soldered portions 24*a*, 24*b*, and 24*b* that are to be soldered to a conductive pattern of the circuit board 2 and the soldered portions 24*a*, 24*b*, and 24*b* are disposed so that when looking along the "first direction", the soldered portion 24*a* is not positioned on a "virtual straight line (the dot-dash line L in FIG. 5)" that joins the positions of the soldered portions 24*b* and 24*b*. Therefore, according to the terminal block 1 and the power supply apparatus 100, when a force is applied along the "second direction", the soldered portions 24*a*, 24*b*, and 24*b* are not susceptible to deformation compared to a configuration where the "soldered portions" are disposed so as to be positioned on a single "virtual straight line", which means it is possible to favorably avoid a situation where the terminal block 1 becomes inclined relative to the circuit board 2, even when the front end of a fixing screw 6 hits the rim portion of an insertion hole 33*h* when the fixing screw 6 is inserted into the insertion hole 33*h* of a casing fixing portion 33 to fix the terminal block 1 to the casing 3 (the upper case 13*a*).

Note that the configurations of the "terminal block" and the "electronic appliance" according to the present invention are not limited to the example configurations described above. As one example, although an example where the terminal block 1 is attached to the circuit board 2 in a state where the substrate facing portion 32 is placed facing the circuit board 2 so that the substrate facing portion 32 directly contacts the first surface of the circuit board 2 has been described, it is also possible to attach a "terminal block" to an "attached substrate" in a state (not illustrated) where the "substrate facing portion" is placed facing the "first surface of the attached substrate" so that various sheets (films), spacers, and the like are sandwiched between the "substrate facing portion" and the "first surface of the attached substrate".

Also, although an example configuration where an entire casing fixing portion 33 including the insertion hole 33*h* is positioned within the width range H described above, so long as the "insertion portion" is positioned within the "width range", it is possible, even if part of the "casing fixing portion" slightly protrudes from the "width range", to sufficiently reduce the size of the "terminal block" along the "third direction" in the same way as the terminal block 1 described above. As a result, it is possible to sufficiently reduce the area of the "attached substrate" occupied by the "terminal block". In addition, for a "terminal block" where a plurality of terminal bodies are disposed in a line like the terminal block 1 described above, even if "casing fixing portions" are each positioned within a "width range" for an adjacent pair of "terminals" (as one example, above the partition wall 34 in the center of the terminal block 1 described above), it is possible, in the same way as the terminal block 1 described above, to sufficiently reduce the size of the "terminal block" along the "third direction". As a result, it is possible to sufficiently reduce the area of the "attached substrate" occupied by the "terminal block".

Figure 7:
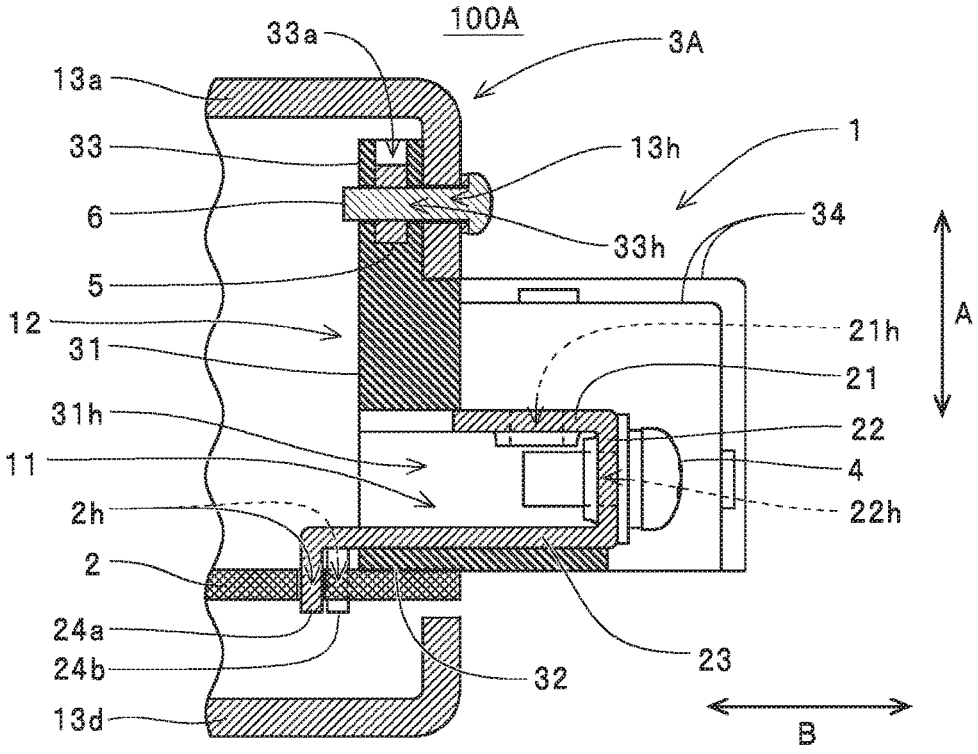
FIG. 7 is a cross-sectional view of a vicinity of a terminal block of another power supply apparatus.

Also, although the power supply apparatus 100 where the insulating sheet 13*c* is interposed between the lower case 13*b* and the circuit board 2 has been described as an example, like a casing 3A of a power supply apparatus 100A (another example of an "electronic appliance" according to the present invention) depicted in FIG. 7, it is possible, when the inner surface of a lower case 13*d* is sufficiently separated from the rear surface of the circuit board 2, to make the insulating sheet 13*c* unnecessary. Here, to prevent a worker's fingers or the like from being inserted between the circuit board 2 and the lower case 13*d* when attaching or detaching connecting wires to and from the terminal block 1 (the terminal bodies 11), an edge portion on the right side in FIG. 7 of the lower case 13*d* of the casing 3A depicted in FIG. 7 is bent upward (toward the circuit board 2). Note that for the power supply apparatus 100A in FIG. 7 and a power supply apparatus 100B depicted in FIG. 8, component elements with the same functions as the power supply apparatus 100 described earlier have been assigned the same reference numerals and duplicated description thereof is omitted.

Also, although the power supply apparatus 100 (100A) where the circuit board 2 to which the terminal block 1 has been attached is housed inside the casing 3 (3A) equipped with the upper case 13*a* and the lower case 13*b* (13*d*) has been described above, it is possible, depending on the specification of the "electronic appliance", to make the lower case 13*b* (13*d*) unnecessary (i.e., to house the circuit board 2 in a "casing" composed of only the upper case 13*a*). In addition, although an example where the terminal block 1 is fixed so that the casing fixing portions 33 are positioned inside the upper case 13*a* of the casing 3 (3A) has been described above, it is also possible to use a configuration (not illustrated) where the terminal block 1 is fixed so that the casing fixing portions 33 are positioned outside the "casing".

Figure 8:
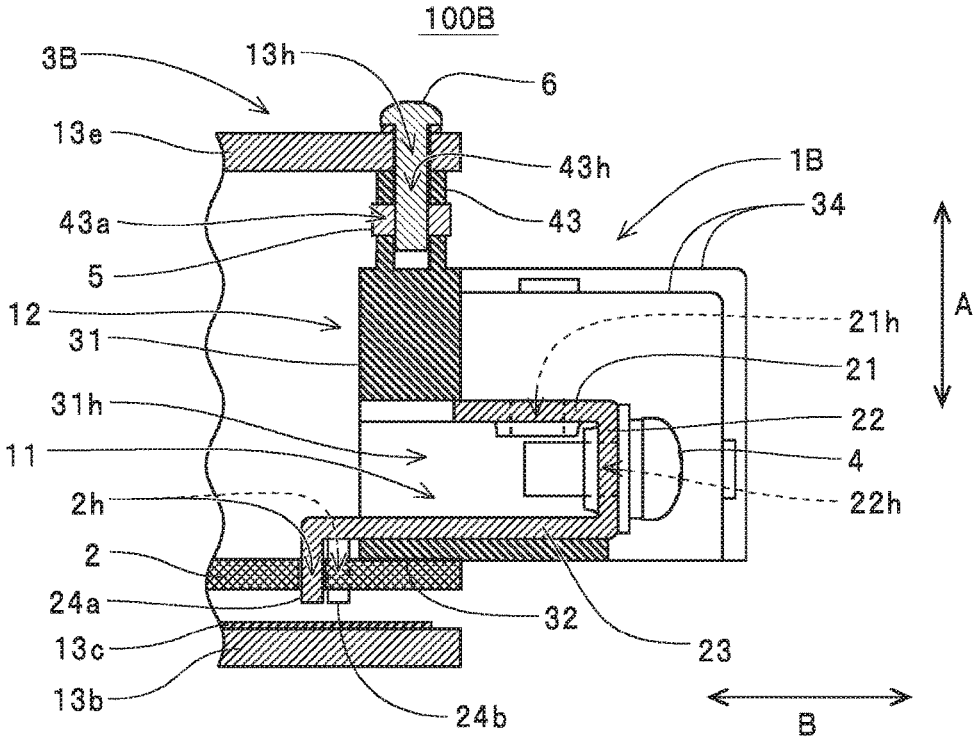
FIG. 8 is a cross-sectional view of a vicinity of a terminal block of another power supply apparatus.

Also, although a configuration where the terminal block 1 is fixed to the upper case 13*a* by screwing the fixing screws 6 into the casing fixing portions 33 along the "second direction" is described above as an example, the configuration of the "casing fixing portions" is not limited to this. As one example, the terminal block 13 in the power supply apparatus 100B (yet another example of an "electronic appliance" according to the present invention) depicted in FIG. 8 is another example of a "terminal block" and includes casing fixing portions 43 in place of the casing fixing portions 33 of the terminal block 1 described earlier.

Here, each casing fixing portion 43 of the terminal block 1B is equipped with an insertion hole 43*h* that is another example of an "insertion portion" for the present invention, and it is possible to fix the terminal block 1B to an upper case 13*e* by inserting the fixing screws 6, which have been inserted through the insertion through-holes 13*h* formed in the upper case 13*e* of the casing 3B that is another example of a "casing" for the present embodiment, into insertion holes 43*h* along the "first direction" (the direction of the arrow A in FIG. 8) and screwing the fixing screws 6 into the fixing nuts 5 that have been fitted into the nut receiving holes 43*a*. The terminal block 1B equipped with the casing fixing portions 43 of this configuration is also capable of achieving the same effect as the terminal block 1 described earlier.

In addition, although a configuration where the terminal block 1 (1B) is fixed to the casing 3 (3A, 3B) by screwing the fixing screws 6 into the fixing nuts 5 has been described as example, in place of a configuration where screw members like the fixing screws 6 are used as the "fastening members" for the present invention, it is also possible to use a configuration where rivets are used as the "fastening members". In addition, although the configurations of the power supply apparatuses 100 (100A, 100B) have been described as examples of an "electronic appliance", the "electronic appliance" for the present invention is not limited to a "power supply apparatus" and it is also possible to apply the present invention to various appliances.

What is claimed is:

1. A terminal block comprising:

a terminal body equipped with a screw hole into which a connecting screw is capable of being screwed to connect a connecting wire; and a terminal holding portion equipped with a substrate facing portion placed facing a first surface of an attached substrate and configured so as to be capable of holding the terminal body, wherein the terminal block is configured so as to be capable of being attached to the attached substrate by soldering the terminal body to a conductive pattern of the attached substrate in a state where the substrate facing portion has been placed facing the first surface, the terminal holding portion is provided with the substrate facing portion at one end in a first direction that becomes parallel to a thickness direction of the attached substrate when the terminal block is attached to the attached substrate, and a casing fixing portion equipped with an insertion portion, into which a fastening member for fixing the terminal holding portion to a casing capable of housing the attached substrate is inserted, is provided at another end in the first direction of the terminal holding portion.

2. The terminal block according to claim 1, wherein the terminal body is configured so that the connecting screw is capable of being screwed into the screw hole in at least one direction out of the first direction and a second direction that becomes parallel to the first surface when the terminal block is attached to the attached substrate, and the terminal holding portion is configured so that when looking along the second direction, the casing fixing portion is positioned within a width range from one end of the terminal body in a third direction that intersects both the first direction and the second direction and another end of the terminal body in the third direction.

3. The terminal block according to claim 1, wherein the terminal body is equipped with at least three soldered portions that are inserted through terminal insertion through-holes provided in the attached substrate and are soldered to the conductive pattern, and the soldered portions are disposed so that when looking along the first direction, at least one soldered portion out of the soldered portions is not positioned on a virtual straight line that joins positions of another two out of the soldered portions.

4. The terminal block according to claim 2, wherein the terminal body is equipped with at least three soldered portions that are inserted through terminal insertion through-holes provided in the attached substrate and are soldered to the conductive pattern, and the soldered portions are disposed so that when looking along the first direction, at least one soldered portion out of the soldered portions is not positioned on a virtual straight line that joins positions of another two out of the soldered portions.

5. An electronic appliance comprising the terminal block according to claim 1, wherein the terminal block is attached to the attached substrate, the attached substrate is housed in the casing, and the terminal block is fixed to the casing.

6. An electronic appliance comprising the terminal block according to claim 2, wherein the terminal block is attached to the attached substrate, the attached substrate is housed in the casing, and the terminal block is fixed to the casing.

7. An electronic appliance comprising the terminal block according to claim 3, wherein the terminal block is attached to the attached substrate, the attached substrate is housed in the casing, and the terminal block is fixed to the casing.

8. An electronic appliance comprising the terminal block according to claim 4, wherein the terminal block is attached to the attached substrate, the attached substrate is housed in the casing, and the terminal block is fixed to the casing.

* * * * *